US005078547A

United States Patent [19]

Calandra, Jr. et al.

[11] Patent Number: 5,078,547

[45] Date of Patent: * Jan. 7, 1992

[54] EXPANSION ASSEMBLY FOR MINE ROOF BOLTS

[75] Inventors: Frank Calandra, Jr., Pittsburgh; John C. Stankus, Cannonsburg, both of Pa.

[73] Assignee: Jennmar Corporation, Pittsburgh, Pa.

[ * ] Notice: The portion of the term of this patent subsequent to Feb. 27, 2007 has been disclaimed.

[21] Appl. No.: 609,882

[22] Filed: Nov. 6, 1990

Related U.S. Application Data

[63] Continuation-in-part of Ser. No. 429,752, Oct. 30, 1989, Pat. No. 4,969,778, which is a continuation of Ser. No. 367,553, Jun. 19, 1989, Pat. No. 4,904,123.

[51] Int. Cl.[5] ..... E21D 20/02

[52] U.S. Cl. ..... 405/259.5; 405/259.6; 411/44; 411/73

[58] Field of Search ..... 405/259, 260, 261; 411/15, 18, 24, 25, 44, 61, 63, 67, 72, 73, 78

[56] References Cited

U.S. PATENT DOCUMENTS

| | | | |
|---|---|---|---|
| 3,181,414 | 5/1965 | Dickow | 411/72 X |
| 3,188,815 | 6/1965 | Schuermann et al. | 61/45 |
| 4,162,133 | 7/1979 | Clark et al. | 405/258 |
| 4,413,930 | 11/1983 | Calandra, Jr. | 405/261 |
| 4,419,805 | 12/1983 | Calandra, Jr. | 29/458 |
| 4,516,885 | 5/1985 | Calandra, Jr. | 405/261 |
| 4,518,292 | 5/1985 | Calandra, Jr. | 411/82 |
| 4,655,645 | 4/1987 | Hipkins, Sr. et al. | 405/261 |
| 4,664,561 | 5/1987 | Frease | 405/261 |
| 4,764,055 | 8/1988 | Clark et al. | 405/261 |
| 4,784,530 | 11/1988 | Price | 405/259 |
| 4,913,593 | 4/1990 | Clark et al. | 405/261 |
| 4,969,778 | 11/1990 | Calandra et al. | 405/261 |

*Primary Examiner*—David H. Corbin
*Attorney, Agent, or Firm*—Stanley J. Price, Jr.

[57] ABSTRACT

An improved expansion assembly for a mine roof bolt adapted for use in a 1½" diameter bore hole with a 1" roof bolt. The expansion assembly has a plug with tapered surfaces, an expansion shell with leaves extending axially upwardly from a support ring into contact with the tapered surfaces of the plug and a support washer. The inner surface of the expansion leaves are spaced inwardly from the surface of the support ring. The expansion leaves have serrations on their outer surfaces such that the serrations are formed by the intersection of a planar surface perpendicular to the axis of the mine bolt and a frusto-conical surface. The end of the leaves on the expansion shell have vertical serrations parallel to the longitudinal axis of the leaf. The tapered plug has channels running longitudinally between the surfaces on the plug for facilitating use of the expansion assembly with resin. The improved expansion assembly may be utilized with or without resin bonding.

19 Claims, 4 Drawing Sheets

EXPANSION ASSEMBLY FOR MINE ROOF BOLTS

CROSS-REFERENCE TO RELATED APPLICATIONS

This application is a continuation-in-part of U.S. application Ser. No. 429,752 entitled "Expansion Assembly For Mine Roof Bolts Utilized In Small Diameter Bore Holes" filed Oct. 30, 1989, now U.S. Pat. No. 4,969,778, which in turn is a continuation of U.S. application Ser. No. 367,553 entitled "Expansion Assembly For Mine Roof Bolts Utilized In Small Diameter Bore Holes" filed June 19, 1989, now U.S. Pat. No. 4,904,123.

BACKGROUND OF THE INVENTION

1. Field of the Invention

This invention relates to an improved expansion assembly for mine roof bolts which are utilized in nominal 1.5" diameter bore holes. The expansion assembly provides greater gripping forces on the inside of the bore hole in the mine roof than can be obtained by similar prior expansion assemblies. The expansion assembly of the present invention may be utilized with or without resin bonding materials.

2. Description of the Prior Art

It is well-known in the art of mine roof control to tension bolts anchored in bore holes drilled into the mine roof in order to reinforce the unsupported rock formation above the roof. Conventionally a hole is drilled through the roof into the rock formation. The end of the bolt in the rock formation is anchored either by engagement of an expansion assembly on the end of the bolt with the rock formation, or by bonding the bolt with resin to the rock formation surrounding the bore hole, or by use of both an expansion assembly and resin together to retain the bolt within the hole. Examples of an arrangement utilizing both an expansion assembly and resin to anchor a mine roof bolt are disclosed in U.S. Pat. No. 4,419,805, U.S. Pat. No. 4,413,930, U.S. Pat. No. 4,516,885 and U.S. Pat. No. 4,518,292. Other examples of utilizing both an expansion assembly and resin to anchor a mine roof bolt are shown in U.S. Pat. No. 3,188,815, U.S. Pat. No. 4,162,133, U.S. Pat. No. 4,655,645 and U.S. Pat. No. 4,664,561.

Expansion assemblies for roof bolts have been utilized for many years without resin being utilized in the same installation. There have been countless efforts to improve the configuration of various components of the expansion assemblies to provide better anchoring within the bore hole. When mechanical anchor assemblies are utilized in conjunction with resin bonding material, additional modifications are often made to accommodate the resin bonding material. U.S. Pat. No. 4,764,055 discloses an expansion assembly which has been modified in many respects to accommodate the use of resin bonding material with the mechanical expansion assembly.

The use of a mechanical expansion assembly and resin bonding together in the same bore hole produces a roof bolt whose anchorage depends upon both the characteristics of the expansion assembly and the characteristics of the resin. The use of the resin tends to mask the characteristics of the expansion assembly and many inferior expansion assemblies have been utilized with resin since the resin bonding enhances the mechanical expansion assembly to the extent that inferiorities in the expansion assembly are not readily discernible.

There are, on the market, many types of expansion assemblies that are manufactured with a tapered plug and expansion leaves so that as the tapered plug is threaded onto the mine roof bolt, it urges the expansion leaves radially outwardly to grip the interior of the bore hole in which the mine roof bolt is inserted. These earlier expansion assemblies are of two general types. One type has a ring to which are affixed several upwardly extending expansion leaves. The ring surrounds the bolt and the tapered plug moves downwardly toward the ring as the assembly is expanded. Another general type of expansion shell is a bail-type shell in which two expansion leaves are supported by a bail that extends over the end of the mine roof bolt and prevents the expansion leaves from moving axially relative to the bolt. The present invention is directed to an improved expansion assembly that has several upwardly extending expansion leaves affixed to a ring to form an expansion shell. U.S. Pat. No. 4,764,055 discloses this general type of expansion assembly. We have taken a commercially available expansion assembly that has been utilized in bore holes and modified its components so that greatly improved gripping power is generated by the expansion assembly when it is utilized in the bore hole of a mine roof. At the same time, this improved expansion assembly has also been modified so that it may optionally be utilized with resin bonding. It need not, however, be utilized with resin bonding and provides greatly enhanced holding power even if no resin bonding is utilized in conjunction with it.

SUMMARY OF THE INVENTION

We have found that by changing the sizes and angles of various components of an expansion assembly previously utilized in bore holes that the expansion assembly has greatly enhanced gripping power as is evidenced by pull tests that have been conducted on mine roof bolts utilizing the improved expansion assembly. A series of size and angle changes to the commercially available expansion assembly have been made to provide a surprising improvement in performance of the expansion assembly of the present invention.

In accordance with the present invention there is provided an expansion assembly for a mine roof bolt having a diameter of about 1" to be utilized in a bore hole having a nominal diameter of about 1.5". The mine roof bolt itself has a threaded end portion and a bolt head at the other end. The mine roof bolt may be formed as a smooth bolt or it may be formed from rebar that is threaded at one end and headed on the other. The expansion assembly includes a tapered plug having a body portion with a threaded internal bore adapted to be threaded onto the bolt threaded end portion. The tapered plug has a plurality of tapered surfaces on the exterior of the body portion of the plug that taper inwardly from straight surfaces as the tapered surfaces extend toward the bolt head when the plug is threaded onto the bolt threaded portion. The tapered surfaces each form an angle of at least 6.5° to the axis of the bolt when the plug is threaded onto the bolt. An expansion shell having a plurality of expansion leaves integrally formed with a support ring is positioned on the bolt so that the support ring is closer to the bolt head and the leaves extend in an axial direction toward the bolt threaded portion. Each of the leaves has a serrated outer surface and a smooth inner surface. The expansion leaves surround the bolt at equal circumferentially spaced distances from each other when the expansion shell is positioned on the roof bolt. Each of the leaf smooth inner surfaces is in abutting contact with one of the tapered plug tapered surfaces whereby the leaves are forced radially outwardly when the tapered plug is threaded axially onto the roof bolt and the leaves are restrained from axial movement relative to the roof bolt. Each of the leaf serrated outer surfaces is formed with seven serration edges extending circumferentially around the leaf outer surface in parallel planes perpendicular to the axis of the bolt and being equally spaced a distance of no more than 0.281". The edges of the serrations are formed by intersecting surfaces with the surface closer to the bolt head being a planar surface perpendicular to the bolt axis and the surface closer to the bolt threaded portion being a frusto-conical surface whose conical elements are at an angle of 75° to the axis of the planar surface. A stop washer is threaded onto the bolt threaded portion closer to the bolt head than the expansion shell whereby the stop washer restricts the expansion shell from axial movement as the plug is threaded onto the bolt threaded portion to force the leaves radially outwardly.

The tapered plug has longitudinal channels formed between the surfaces to facilitate the flow of resin down, past and around the expansion assembly, and horizontal channels on the top surface of the plug extending from the longitudinal channels to the bore in the plug.

We have found that by increasing the angle of taper on the plug tapered surfaces, by reducing the number of serrations on the outer surface of the expansion leaves, and by reducing the angle between the conical surface and the planar surface forming the serrations, we have been able to greatly enhance the holding power of prior commercially available expansion assemblies.

In addition, we have been able to adapt the improved expansion assembly to be utilized with resin bonding more efficiently by forming channels in the tapered plug to permit resin to run down alongside the tapered plug within the bore hole, and by providing a reduced expansion shell base to provide sufficient metal to support the leaves and yet increase the annular area between the shell base portion and the bore hole wall to permit resin to pass through the annular area downwardly from above the expansion assembly to below it. We have also found that vertical serrations provided in the upper edges of the expansion leaves facilitate more efficient engagement of the expansion shell leaves with the bore hole wall to prevent spinning of the expansion shell and to provide better initial contact between the expansion shell leaves and the bore hole wall.

Accordingly, the principal object of the present invention is to provide an expansion assembly for use in a nominal 1.5" diameter bore hole which will produce greatly enhanced gripping power when the expansion assembly is utilized to secure a mine roof bolt in the bore hole.

Another object of the present invention is to provide an improved expansion assembly for a 1.5" nominal diameter bore hole which may be utilized with or without resin bonding to enhance the capabilities of the expansion assembly.

A further object of the present invention is to provide an improved mine roof bolt expansion assembly which, when utilized with resin bonding, has features that make the resin more effectively flow down, past and around the expansion assembly on the bolt.

These and other objects of the present invention will be more completely disclosed and described in the following specification, the accompanying drawings and the appended claims.

DESCRIPTION OF THE PREFERRED EMBODIMENT

Figure 1:
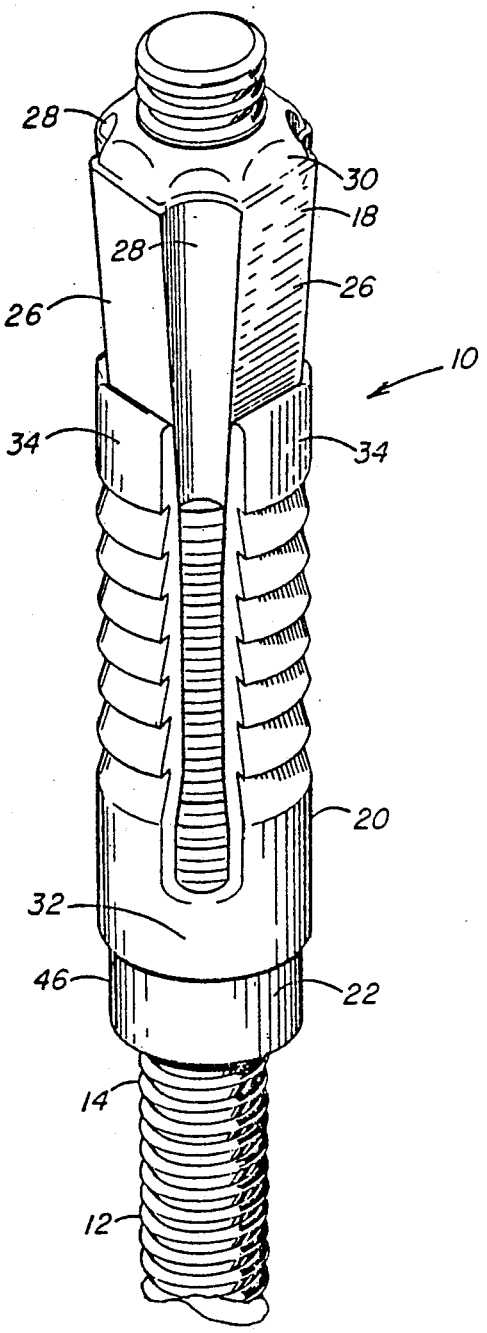
FIG. 1 is a perspective view of the expansion assembly of the present invention.
Figure 2:
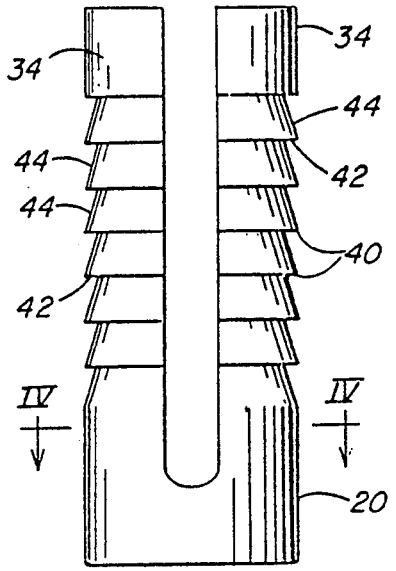
FIG. 2 is an elevational view of the expansion shell of the present invention.
Figure 3:
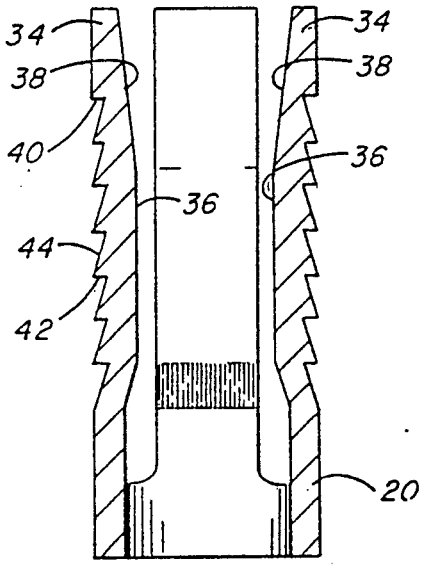
FIG. 3 is an elevational view in section of the expansion shell of the present invention.
Figure 4:
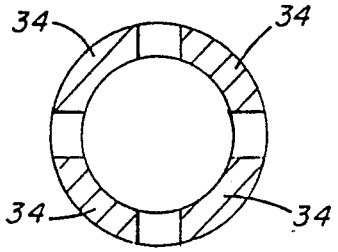
FIG. 4 is a sectional view taken along line IV—IV of FIG. 2.
Figure 7:
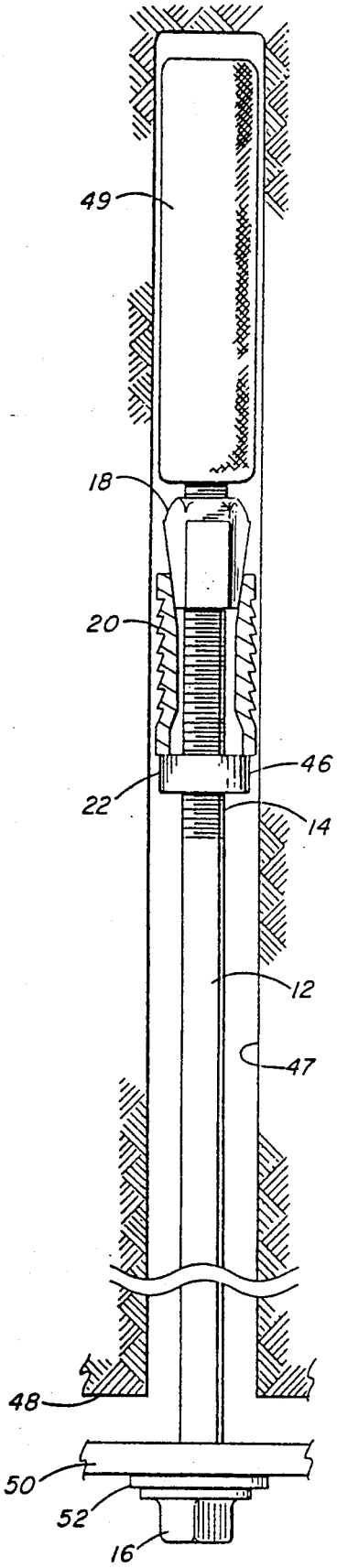
FIG. 7 is a view of the expansion assembly of the present invention on a mine roof bolt positioned within a bore hole in the mine roof.
Figure 8:
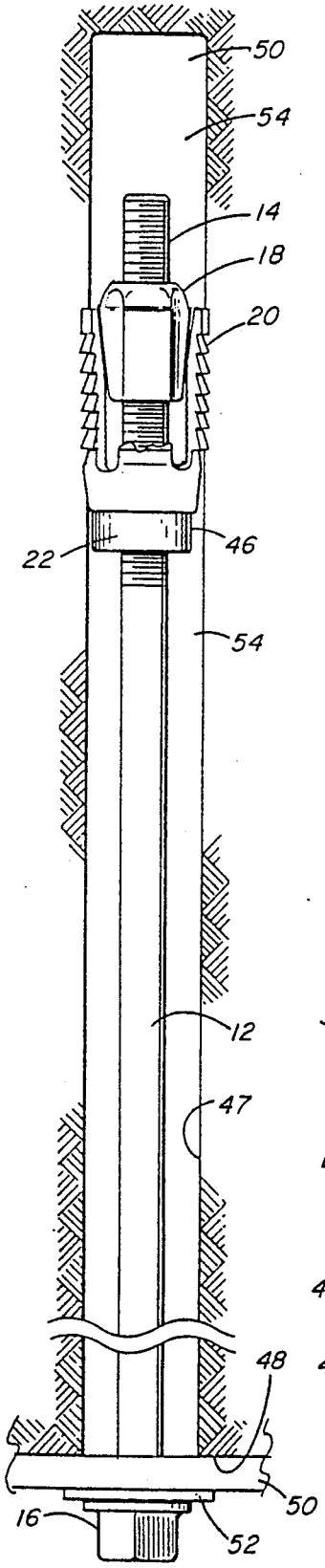
FIG. 8 is a view of the expansion assembly of FIG. 7 expanded within the bore hole in a mine roof.

Referring to the drawings, and more particularly to FIG. 1, there is shown an expansion assembly generally designated at 10 which is threaded onto a mine roof bolt 12. As shown in FIGS. 7 and 8, the mine roof bolt 12 has a threaded end 14 and a head 16 formed integrally therewith. The roof bolt 12 may be formed either as a smooth bolt having the threaded end 14 and head 16 or as a rebar that has a threaded end 14 and a head 16.

Figure 5:
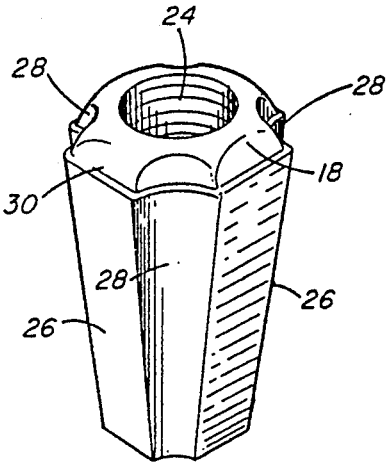
FIG. 5 is a perspective view of the tapered plug of the present invention.

Referring to FIGS. 1-5, the expansion assembly 10 has a tapered plug 18, an expansion shell 20 and a stop washer 22. The tapered plug 18 is internally threaded at 24 so that it threadingly receives the threaded end portion 14 of bolt 12. The tapered plug 18 has four tapered surfaces 26 that are longitudinally separated by grooves 28 as best seen in FIGS. 1 and 5. The tapered plug 18 has a rounded end 30 to enable the tapered plug to pass readily through resin in the event that the expansion assembly 10 is used with resin bonding in a bore hole. The grooves 28 permit the resin to pass longitudinally down beyond the plug 18 when resin is utilized.

Figure 6:
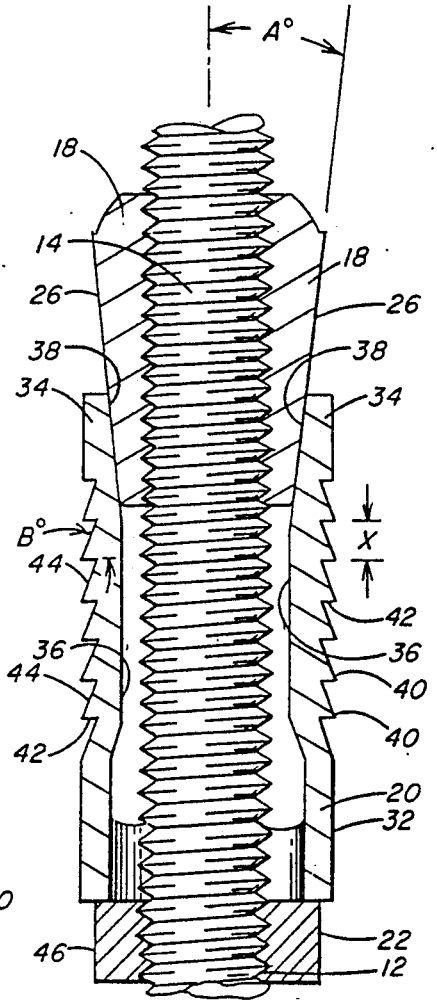
FIG. 6 is a sectional view of the expansion assembly of the present invention in an assembled condition.

As seen in FIG. 6, the four tapered surfaces 26 each form an angle A with the axis of the roof bolt 12 when the tapered plug 18 is threaded onto the threaded end 14 of bolt 12. Angle A is preferably at least 6.5°.

The expansion shell 20 has a support ring 32 that encircles the bottom portion of the expansion shell 20. Four leaves 34 extend axially upwardly from the support ring 32 as seen in FIG. 1. The leaves 34 have smooth internal surfaces 36 that have tapered portions 38 to register with the tapered surfaces 26 of tapered plug 18.

Each of the leaves 34 on expansion shell 20 has seven serrations 40 formed thereon. The serrations 40 are formed by the intersection of planar surfaces 42 that are perpendicular to the axis of the roof bolt 12 when the expansion shell 20 is in an unexpanded condition and by frusto-conical surfaces 44 whose conical axis coincides with the axis of the roof bolt 12.

As seen in FIG. 6, the frusto-conical surfaces 44 and the planar surfaces 42 come together at an angle B which is preferably 72.3°. As further seen in FIG. 6, the distance between serrations 40, as indicated at X, is preferably 0.188" but should not be less than 0.186" nor more than 0.188". The entire expansion shell 20 is no more than 2.35" in length.

The expansion assembly in one embodiment of the present invention is designed to be utilized in a bore hole having a nominal diameter of 1". The roof bolt 12 has a nominal diameter of ⅝". The maximum diameter of the tapered plug 18 is 0.960" and the maximum diameter of the unexpanded expansion shell 20 is 0.938".

The expansion shell 20, which fits freely around roof bolt 12 is supported on the roof bolt by stop washer 22. Stop washer 22 is threadedly received on the roof bolt threaded end 14 and has a cylindrical external surface 46. The diameter of cylindrical external surface 46 is less than the unexpanded diameter of expansion shell 20 so as not to inhibit the flow of resin down and around the expansion assembly 10 when the expansion assembly is utilized with resin.

As seen in FIGS. 7 and 8, the expansion assembly 10 and roof bolt 12 are utilized in a bore hole 47 formed within a mine roof 48. In this instance, the expansion assembly 10 and roof bolt 12 are utilized with resin bonding. It will be appreciated that the expansion assembly 10 of the present invention need not be utilized with resin bonding.

As shown in FIG. 7, a resin capsule 49 is positioned within bore hole 47 above the expansion assembly 10. Expansion assembly 10 and roof bolt 12 rupture the resin capsule 49 and cause the resin to flow downwardly over the expansion assembly 10. As the roof bolt is rotated, the contents of the resin capsule 49 are mixed together to form a resin mixture 54 as shown in FIG. 8. In conventional fashion, the roof plate 50 and washer 52 that surround roof bolt 12 at its head 16 are drawn upwardly against the mine roof 48 as the roof bolt 12 continues to be rotated and threaded through the tapered plug 18.

Because of the construction of tapered plug 18 with grooves 28 and rounded end 30, the expansion assembly 10 passes easily up into the resin mixture 54 and the resin flows downwardly around and past the expansion assembly 10 and stop washer 22. The expansion assembly 10 of the present invention may readily be utilized with resin bonding to provide a secure anchor within the bore hole 47.

We have found that the configuration of the expansion assembly 10 of the present invention provides a very efficient mechanical expansion arrangement for a mine roof bolt even when utilized without resin bonding. In three tests of a roof bolt constructed in accordance with that described herein, the following results were obtained.

Test No. 1. An expansion assembly on a nominal ⅝" bolt that was 34" long was expanded in a test bore with an installed torque of 200 foot pounds. No resin was utilized. Under a load of 18,000 pounds there was a total deflection of the bolt of only 0.220".

Test No. 2. An expansion assembly on a nominal ⅝" bolt that was 34" long was expanded in a test bore with an installed torque of 200 foot pounds. No resin was utilized. Under a load of 18,000 pounds there was a total deflection of the bolt of only 0.198".

Test No. 3. An expansion assembly on a nominal ⅝" bolt that was 34" long was expanded in a test bore with an installed torque of 200 foot pounds. No resin was utilized. Under a load of 18,000 pounds there was a total deflection of the bolt of only 0.153".

Referring to the embodiment of FIGS. 9–20, there is shown an expansion assembly generally designated at 110 which is threaded onto a mine roof bolt 112. The mine roof bolt 112 has a threaded end 113 and a head (not shown) formed integrally therewith. The roof bolt 112 may be formed either as a smooth bolt having a threaded end and head or as a rebar that has a threaded end and head. The head end of the bolt 112 has a roof plate (not shown) between the head and the threaded end of the roof bolt 112.

Figure 9:
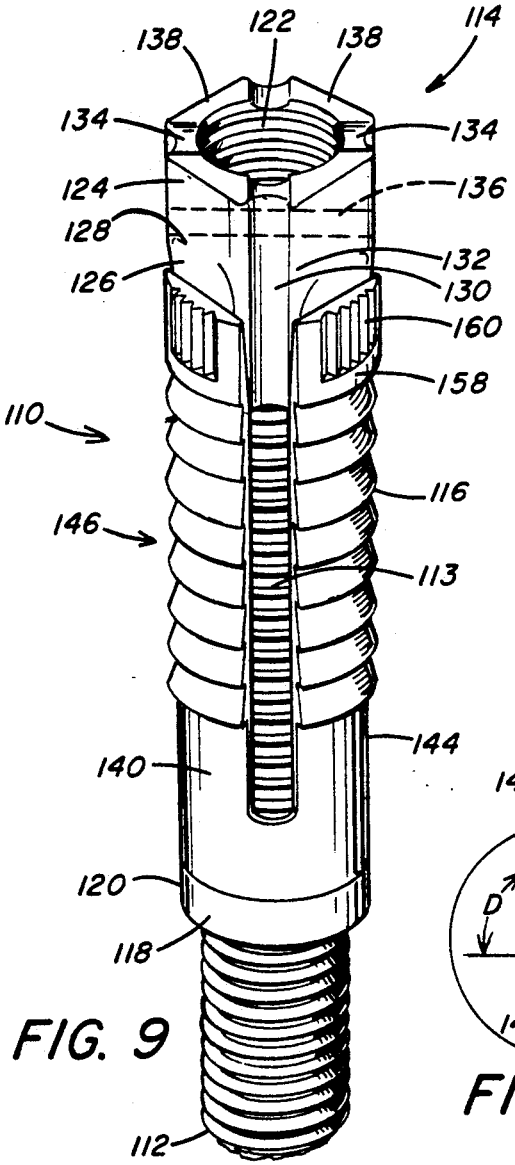
FIG. 9 is a perspective view of another embodiment of an expansion assembly of the present invention.
Figure 16:
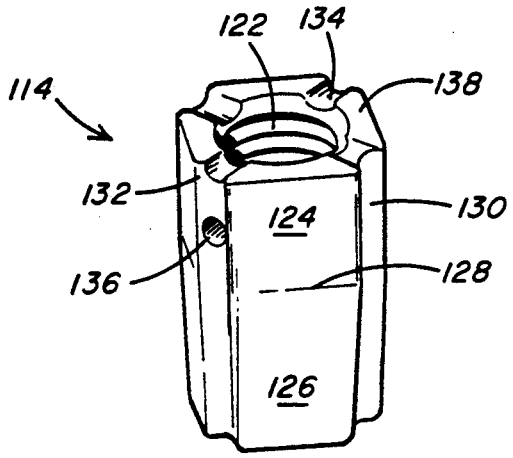
FIG. 16 is a perspective view of the tapered plug of the embodiment illustrated in FIG. 9.
Figure 17:
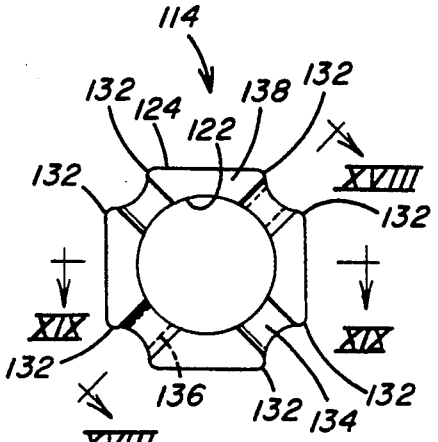
FIG. 17 is a top plan view of the tapered plug shown in FIG. 16.
Figure 18:
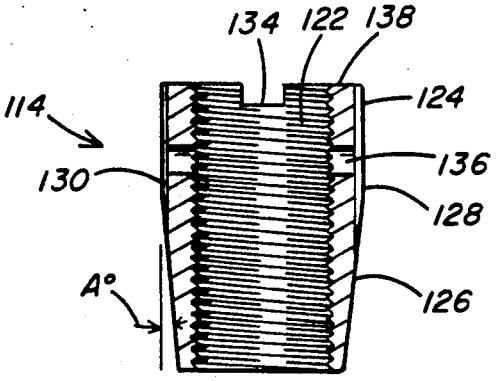
FIG. 18 is an elevational view of the tapered plug taken in section along line XVIII—XVIII of FIG. 17.
Figure 19:
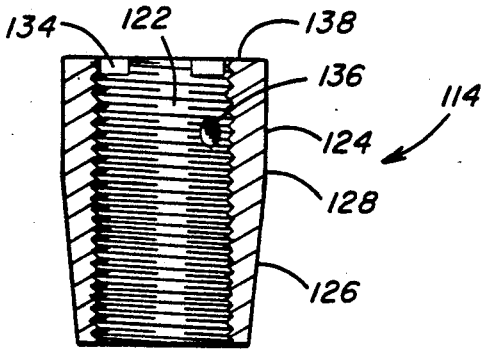
FIG. 19 is another view in section of the tapered plug taken along line XIX—XIX of FIG. 17.
Figure 20:
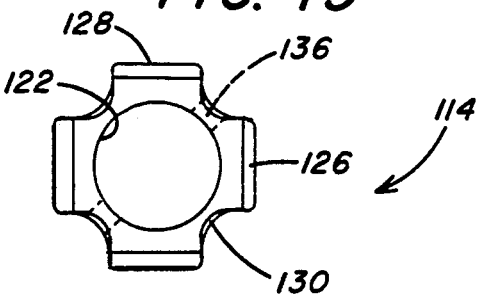
FIG. 20 is a bottom plan view of the tapered plug of the present invention.

Referring to FIG. 9, the expansion assembly 110 has a tapered plug 114, an expansion shell 116 and a stop washer 118. The stop washer 118 has an outside diameter 120 preferably no larger than the outside diameter of the support ring 140 of the expansion shell 116 to allow resin to flow around stop washer 118 if resin is utilized. The tapered plug 114 is internally threaded at 122 so that it threadedly receives the threaded end portion 113 of bolt 112. The tapered plug 114 has four surface portions 124 and four other tapered surfaces 126 that intersect at 128. Surfaces 124 are longitudinally separated by grooves 130 as best seen in FIGS. 9, 16 and 18. The tapered plug 114 longitudinal grooves 130 permit resin to pass longitudinally down beyond the plug 114 when resin is utilized. Horizontal grooves 134 connect to the longitudinal grooves 130 and extend across the top 138 of the tapered plug 114 from longitudinal grooves 130 to bore 122. The tapered plug 114 has a transverse bore 136 shown in FIGS. 16 and 18 for receiving a stop means (not shown) such as a shear pin to cause rotation of the expansion shell assembly 110 with the roof bolt 112 to mix the resin when resin is utilized. When the resin increases in viscosity, the bolt 112 shears the shear pin in the transverse bore 136 and the head end of the bolt advances toward the end of the bore hole and urges the plate against the mine roof, thus compressing the rock strata in the mine roof. The edges 132 on either side of the longitudinal grooves 130 are preferably chamfered as shown in FIGS. 9, 16 and 17 to further enable passage of resin past plug 114.

As shown in FIG. 18, the four tapered surfaces 126 each form an angle A' with the axis of the roof bolt 112 when the tapered plug 114 is threaded onto the threaded end 113 of the bolt 112. Angle A' is preferably at least 6.5°.

The bottom portion of the expansion shell 116 has a support ring 140. The inner surface 142 of the support ring 140 has an inside diameter Y' (see FIG. 11) of about 1.060, and the outer surface 144 of the support ring 140 has an outer diameter of about 1.340 to allow resin to pass through and below support ring 140. Four leaves 146 extend axially upwardly from the support ring 140 as may be seen in FIGS. 9, 10 and 11. The leaves 146 have smooth internal surfaces 148 that have tapered portions 150 to register with the tapered surfaces 126 of tapered plug 114.

Figure 10:
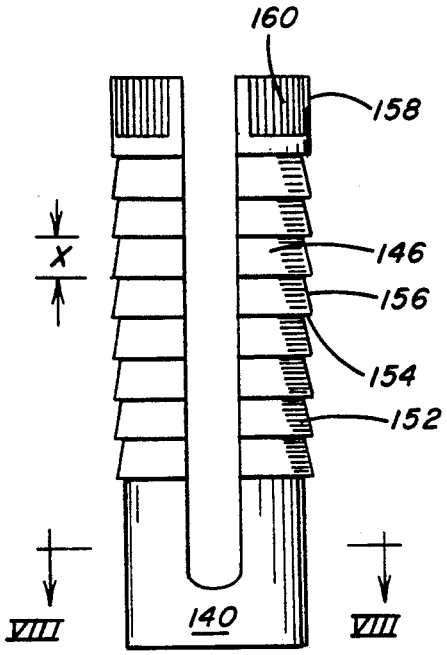
FIG. 10 is an elevational view of the embodiment of the expansion shell illustrated in FIG. 9.

Each of the leaves 146 on expansion shell 116 has seven serrations 152 formed thereon. The serrations 152 are formed by the intersection of planar surfaces 154 perpendicular to the axis of the roof bolt 112 when the expansion shell 116 is in an unexpanded condition and by frusto-conical surfaces 156 whose conical axis intersects the axis of the roof bolt 112 at an angle of about 15° when the expansion shell 116 is unexpanded on roof bolt 112. As seen in FIG. 10, the frusto-conical surfaces 156 and the planar surfaces 154 come together at an angle B' which is preferably about 75°. As further seen in FIG. 10, the distance between the serrations 152, as indicated at X', is preferably about 0.281". The entire expansion shell 116 is preferably no more than 4" in length.

The expansion assembly 110 of the present invention is designed to be utilized in a bore hole having a nominal diameter of about 1.5". The roof bolt 112 has a nominal diameter of about 1". The maximum diametrical dimension of the tapered plug 114 is about 1.4375", and the maximum diameter of the unexpanded expansion shell 116 is about 1.340".

Figure 15:
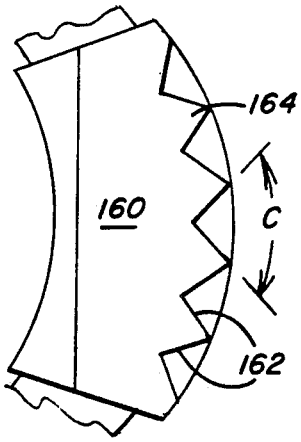
FIG. 15 is an enlarged view of the circled area designated 15 in FIG. 12.
Figure 13:
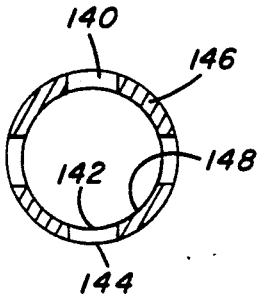
FIG. 13 is a sectional view taken along line XIII—XIII of FIG. 10.

As seen in FIGS. 9, 10, 12 and 15, the leaves 146 of the expansion shell assembly 110 have an end surface 158 distal to the support ring 140. The ends 158 of the leaves 146 have vertical serrations 160 perpendicular to the axis of the serrations 152. The vertical serrations 160 have walls 162 which form conical projections 164 as shown in FIG. 15. The walls 162 form angles C' to each other. As shown in FIG. 15, angle C' is preferably about 92°. The vertical serrations 160 are at the end portion 158 of leaves 146, and are the first portion of the leaves 146 to engage the bore hole wall. The vertical serrations 160 function to engage the bore hole wall to prevent the expansion shell 116 from rotating with the mine roof bolt 112, or to prevent "spinning" of the expansion shell 116.

Figure 11:
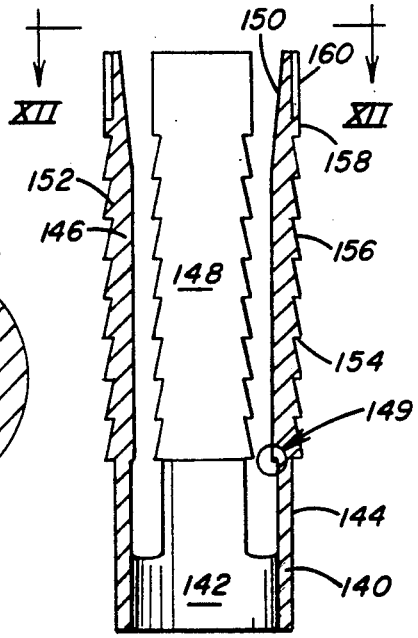
FIG. 11 is an elevational view in section of the expansion shell illustrated in FIG. 9.
Figure 12:
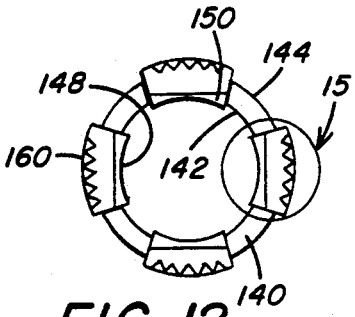
FIG. 12 is a sectional view taken along line XII—XII of FIG. 11.

To facilitate the flow of resin past and around the expansion shell 116, the support ring 140 of the expansion shell 116 has an inside diameter less than the inside diameter of the leaves 146 extending around bolt 112 from support ring 140 in the unexpanded condition. As shown in FIG. 11, the diameter Y' from the inner surface 142 of the support ring 140 is greater than the diameter from the inner surface 148 of leaves 146 to increase the annular area between the inner surface 142 of the support ring 140 and the roof bolt 112 to accomodate passage of the resin therethrough.

Figure 14:
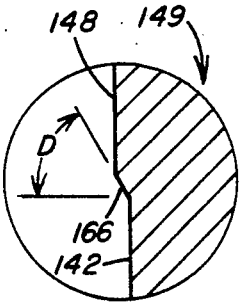
FIG. 14 is an enlarged view of the circled area shown in FIG. 11.

As shown in FIGS. 11 and 14, the expansion shell 116 has at the junction generally designated by the numeral 149 of the smooth inner surface 148 of the leaves 146 and the inner surface 142 of the support ring 140 an offset portion 166 having an angle D' which is about 60° to the axis perpendicular to the longitudinal axis of the expansion shell 116 as shown in FIG. 14. The offset portion 166 allows increased flexibility in the support ring 140 to prevent a fulcrum effect between the support ring 140 and leaves 146 to prevent the leaves 146 from breaking off and to increase in the inside diameter of the support ring 140 to accomodate the flow of resin past the expansion shell assembly 110. The inside diameter of the support ring 140 is about 1.060" as indicated in FIG. 11 at Y'. The offset portion 166 allows the leaves 146 to expand outwardly with less resistance and allows the leaves 146 to be substantially thicker than the support ring 140.

The expansion shell 116, which fits freely around roof bolt 112, is supported on the roof bolt 112 by stop washer 118. Stop washer 118 is threadedly received on the roof bolt 112 threaded end 113. In use, the expansion assembly 110 of the present invention may be utilized with resin bonding or may be utilized without resin bonding.

When utilized with resin bonding, a resin capsule is positioned within a bore hole above the expansion assembly 110. Expansion assembly 110 and roof bolt 112 rupture the resin capsule and cause the resin to flow downwardly over the expansion assembly 110. As the roof bolt 112 is rotated, the contents of the resin capsule are mixed together to form a resin mixture. As the resin is mixed by the expansion assembly 110, the viscosity of the resin increases and prevents further rotation of the expansion assembly 110. As the bolt 112 is further rotated, bolt 112 shears the shear pin in transverse bore 136 and advances into plug 114. In conventional fashion, a roof plate and a washer that surround the roof bolt 112 at its head are drawn upwardly against the mine roof as the roof bolt 112 continues to be rotated and threaded through the tapered plug 114.

Because of the construction of tapered plug 114 with grooves 130, 134, the expansion assembly 110 passes easily up into the free resin and the resin flows downwardly around and past the expansion assembly 110 and stop washer 118. The expansion assembly 110 of the present invention may readily be utilized with resin bonding to provide a secure anchor within the bore hole.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. An expansion assembly for a mine roof bolt having a threaded portion with a nominal diameter of about 1" to be utilized in a bore hole having a nominal diameter of about 1½", said mine roof bolt having said threaded portion at one end and a bolt head at the other end, said expansion assembly comprising:

a tapered plug having a body portion with a threaded internal bore and a longitudinal axis, said tapered plug adapted to be threaded onto said bolt threaded end portion, said tapered plug having a plurality of tapered surfaces extending at an angle from a plurality of planar, flat surfaces extending axially on the exterior of said body portion, said tapered surfaces taper inwardly as said tapered surfaces extend toward said bolt head when said plug is threaded onto said bolt threaded portion, said tapered surfaces each forming an angle of about 6.5° to said longitudinal axis of said plug;

an expansion shell having a plurality of expansion leaves integrally formed with a support ring and positioned on said bolt so that said support ring is closer to said bolt head and said leaves extend in an axial direction away from said bolt head, said leaves each having a serrated outer surface and a smooth inner surface, said expansion leaves surrounding said bolt at equal circumferentially spaced distances from each other, each of said leaf smooth inner surfaces arranged to be in abutting with one of said tapered plug tapered surfaces whereby said leaves are forced radially outwardly when said tapered plug is threaded axially onto said roof bolt and said leaves are restrained from axial movement relative to said roof bolt, each of said leaf serrated outer surfaces being formed with a plurality of serration edges extending around said leaf outer surface and being equally spaced a distance apart of about 0281", said edges of said serrations being by intersecting surfaces with the surface closer to said formed bolt head being a planar surface generally perpendicular to said bolt axis and the surface closer to said bolt threaded end portion having a frusto-conical surface extend at an angle of about 75° to said planar surface;

a stop washer threaded onto said bolt threaded portion closer to said bolt head than said expansion shell whereby said stop washer restricts said expansion shell from axial movement as said plug is threaded onto said bolt threaded portion to force said leaves radially outwardly;

said support ring having a larger inside diameter than said expansion leaves inner surface when said leaves are in said unexpanded state; and an offset portion extending longitudinally between the inner surfaces of said support ring and the inner surfaces of said expansion leaves to allow increased flexibility in said support ring, and said offset portion extending angularly at about 60° to the axis perpendicular to the longitudinal axis of said support ring.

2. An expansion assembly as set forth in claim 1 in which said leaves include vertical serrations on their ends distal from said support ring, said vertical serrations being substantially parallel to the longitudinal axis of said leaves.

3. An expansion assembly as set forth in claim 2 wherein said vertical serrations form an angle of about 92° between each adjacent surface of adjacent vertical serrations.

4. An expansion assembly as set forth in claim 1 wherein said tapered plug body portion has longitudinal channels formed therein between said plug surfaces to facilitate the flow of resin around said expansion assembly.

5. An expansion assembly as set forth in claim 4 in which the edges of said longitudinal channels included chamfered portions.

6. An expansion assembly as set forth in claim 1 wherein said tapered plug has a maximum diametrical dimension of about 1.4375" and said expansion shell has a maximum diametrical dimension of about 1.340" in the unexpanded state.

7. An expansion assembly as set forth in claim 1 wherein said expansion leaf smooth inner surfaces each have a portion adjacent the end closer to said bolt threaded end portion that is tapered to receive said plug tapered surfaces.

8. An expansion assembly for a mine roof bolt having a threaded portion with a nominal diameter of about 1" to be utilized in a bore hole having a nominal diameter of about 1½", said mine roof bolt having said threaded portion at one end and a bolt head at the other end, said expansion assembly comprising:

a tapered plug having a body portion with a threaded internal bore and a longitudinal axis, said tapered plug adapted to be threaded onto said bolt threaded end portion, said tapered plug having a plurality of tapered surfaces extending at an angle from a plurality of planar, flat surfaces extending axially on the exterior of said body portion, said tapered surfaces taper inwardly as said tapered surfaces extend toward said bolt head when said plug is threaded onto said bolt threaded portion, said tapered surfaces each forming an angle of about 6.5° to said longitudinal axis of said plug;

an expansion shell having a plurality of expansion leaves integrally formed with a support ring and positioned on said bolt so that said support ring is closer to said bolt head and said leaves extend in an axial direction away from said bolt head, said leaves each having a serrated outer surface and a smooth inner surface, said expansion leaves surrounding said bolt at equal circumferentially spaced distances from each other, each of said leaf smooth inner surfaces arranged to be in abutting relation with one of said tapered plug tapered surfaces whereby said leaves are forced radially outwardly when said tapered plug is threaded axially onto said roof bolt and said leaves are restrained from axial movement relative to said roof bolt, each of said leaf serrated outer surfaces being formed with a plurality of serration edges extending around said leaf outer surface and being equally spaced a distance apart of about 0.281", said edges of said serrations being formed by intersecting surfaces with the surface closer to said bolt head being a planar surface generally perpendicular to said bolt axis and the surface closer to said bolt threaded end portion having a frusto-conical surface extend at an angle of about 75° to said planar surface;

a stop washer threaded onto said bolt threaded portion closer to said bolt head than said expansion shell whereby said stop washer restricts said expansion shell from axial movement as said plug is threaded onto said bolt threaded portion to force said leaves radially outwardly;

said support ring having a larger inside diameter than said expansion leaves inner surface when said leaves are in said unexpanded state and said support ring having between said interior of said support ring and said interior surface of said expansion leaves an offset portion extending angularly at about 60620 to the axis perpendicular to the longitudinal axis of said support ring;

said tapered plug body portion having longitudinal channels formed therein between said plug surfaces to facilitate the flow of resin around said expansion assembly; and said tapered plug body portion having a top surface and horizontal channels in said top surface connected to said longitudinal channels.

9. An expansion shell of a mine roof bolt expansion assembly for a mine roof bolt having a threaded portion with a nominal diameter of about 1" to be utilized in a bore hole having a nominal diameter of about 1½" comprising:

a plurality of expansion leaves integrally formed with a support ring and extending axially from said support ring, each of said expansion leaves having a serrated outer surface and a smooth inner surface, said serrated outer surface having seven separate serrations formed thereon, each of said serrations being formed by the intersection of a planar surface and a frusto-conical surface whereby said planar surface is generally perpendicular to the axis of said mine roof bolt in the position assumed by said expansion leaf relative to said bolt in the unexpanded condition of said expansion assembly and said frusto-conical surfaces extend at an angle of about 75° to said planar surfaces, said serrations being equally spaced from each other a distance of about 0.281".

10. An expansion shell as set forth in claim 9 wherein the total length of said shell does not exceed 4".

11. A plug for use with a mine roof bolt expansion assembly comprising, a body portion with a top surface connected to and spaced from a bottom surface by a plurality of side surfaces, said side surfaces having a straight portion and a tapered portion, said straight portion extending from said top surface and being parallel to the longitudinal axis of said plug and said tapered portion extending at an angle of at least 6.5° from said straight portion toward said bottom surface, said side surfaces being separated from each other by longitudinal grooves, said longitudinal grooves each having opposite edges being chamfered to facilitate the flow of resin past said plug body portion in the mine roof bolt expansion assembly, and said plug body portion having a threaded bore extending axially through said plug body portion parallel to said straight portions of said side surfaces.

12. A plug for use with a mine roof bolt expansion assembly comprising, a body portion with a top surface connected to and spaced from a bottom surface by a plurality of side surfaces, said side surfaces having a straight portion and a tapered portion, said straight portion extending from said top surface and being parallel to the longitudinal axis of said plug and said tapered portion extending at an angle of at least 6.5° from said straight portion toward said bottom surface, said side surfaces being separated by longitudinal grooves extending between the edges of said side surface, said plug having a threaded bore extending axially through said plug body portion parallel to said straight portions of said side surfaces, and said top surface of said plug having channel portions extending from said longitudinal grooves to said bore.

13. An expansion shell for use with a mine roof bolt expansion assembly comprising, a support ring, a plurality of expansion leaves integrally formed with said support ring, said leaves each having a serrated outer surface and a smooth inner surface, said leaves being equally spaced from each other and extending axially from said support ring, said leaves having horizontal serrations perpendicular to the longitudinal axis of said support leaves, said support ring including an inner surface having a larger inside diameter than said inner surface of said leaves when said expansion shell is in the unexpanded condition, and an offset portion forming a junction between said inner surface of said support ring and said inner surface of said leaves, said offset portion extending longitudinally from said support ring and angled from said inner surface of said leaves toward said inner surface of said support ring.

14. An expansion shell for use with a mine roof bolt expansion assembly as set forth in claim 13 in which, said offset portion being offset at an angle of about 60° to the axis perpendicular to the longitudinal axis of said support ring.

15. An expansion shell for use with a mine roof bolt expansion assembly as set forth in claim 13 in which, said leaves include vertical serrations parallel to the longitudinal axis of said support leaves at the end of said leaf distal to said support ring.

16. An expansion shell for use with a mine roof bolt assembly as set forth in claim 13 wherein, said leaves include vertical serrations spaced from said distal end of said leaves no more than about 0.320" from said distal end of said leaf.

17. An expansion shell for use with a mine roof bolt expansion assembly as set forth in claim 13 wherein, said vertical serrations form conical projections extending from the surface of said leaf about 0.050".

18. An expansion shell for use with a mine roof bolt assembly as set forth in claim 13 wherein, each said vertical serration having a pair of walls, said walls of each said vertical serration intersecting said walls of the adjacent vertical serration at an angle of about 92° to each other.

19. An expansion shell for use with a mine roof bolt expansion shell assembly as set forth in claim 13 wherein, said vertical serration are perpendicular to said horizontal serrations.

* * * * *